US008059074B2

(12) United States Patent
Kim et al.

(10) Patent No.: US 8,059,074 B2
(45) Date of Patent: Nov. 15, 2011

(54) LIQUID CRYSTAL DISPLAY AND COMMON VOLTAGE GENERATING CIRCUIT THEREOF

(75) Inventors: Ki-Bum Kim, Incheon (KR); Jae-Goo Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 826 days.

(21) Appl. No.: 11/833,450

(22) Filed: Aug. 3, 2007

(65) Prior Publication Data

US 2008/0074410 A1 Mar. 27, 2008

(30) Foreign Application Priority Data

Sep. 13, 2006 (KR) ..... 10-2006-0088710

(51) Int. Cl.
*G09G 3/36* (2006.01)

(52) U.S. Cl. ..... 345/87; 345/100; 345/204

(58) Field of Classification Search ..... 345/87–100, 345/211

See application file for complete search history.

(56) References Cited

U.S. PATENT DOCUMENTS

| | | | | |
|---|---|---|---|---|
| 7,050,027 | B1 * | 5/2006 | Macrae | 345/87 |
| 2003/0020724 | A1 * | 1/2003 | O'Donnell | 345/589 |
| 2003/0231155 | A1 * | 12/2003 | Ogawa | 345/89 |
| 2004/0036666 | A1 | 2/2004 | Tsutsui et al. | |
| 2005/0012874 | A1 * | 1/2005 | Wu et al. | 349/58 |
| 2005/0206641 | A1 * | 9/2005 | Morita | 345/211 |

FOREIGN PATENT DOCUMENTS

| | | |
|---|---|---|
| JP | 2004-021067 | 1/2004 |
| KR | 1020030068824 A | 8/2003 |
| KR | 1020040002622 A | 1/2004 |
| KR | 1020040077188 A | 9/2004 |

* cited by examiner

*Primary Examiner* — Alexander Eisen
*Assistant Examiner* — Viet Pham
(74) *Attorney, Agent, or Firm* — F. Chau & Associates, LLC

(57) ABSTRACT

A voltage generating circuit includes a first storage unit, a second storage unit, and a voltage generator. The first storage unit stores first voltage data, and the second storage unit stores second voltage data. The voltage generator generates a voltage corresponding to one of the first and the second voltage data according to whether the second voltage data is changed from the first voltage data.

24 Claims, 4 Drawing Sheets

Fig. 3

| VCM5 | VCM4 | VCM3 | VCM2 | VCM1 | VCM0 | VCOM Vlotage | VCM5 | VCM4 | VCM3 | VCM2 | VCM1 | VCM0 | VCOM Vlotage |
|---|---|---|---|---|---|---|---|---|---|---|---|---|---|
| 0 | 0 | 0 | 0 | 0 | 0 | Setting disable | 1 | 0 | 0 | 0 | 0 | 0 | 4.01V |
| 0 | 0 | 0 | 0 | 0 | 1 | 3.03V | 1 | 0 | 0 | 0 | 0 | 1 | 4.05V |
| 0 | 0 | 0 | 0 | 1 | 0 | 3.06V | 1 | 0 | 0 | 0 | 1 | 0 | 4.08V |
| 0 | 0 | 0 | 0 | 1 | 1 | 3.09V | 1 | 0 | 0 | 0 | 1 | 1 | 4.11V |
| 0 | 0 | 0 | 1 | 0 | 0 | 3.12V | 1 | 0 | 0 | 1 | 0 | 0 | 4.14V |
| 0 | 0 | 0 | 1 | 0 | 1 | 3.16V | 1 | 0 | 0 | 1 | 0 | 1 | 4.17V |
| 0 | 0 | 0 | 1 | 1 | 0 | 3.19V | 1 | 0 | 0 | 1 | 1 | 0 | 4.21V |
| 0 | 0 | 0 | 1 | 1 | 1 | 3.22V | 1 | 0 | 0 | 1 | 1 | 1 | 4.24V |
| 0 | 0 | 1 | 0 | 0 | 0 | 3.25V | 1 | 0 | 1 | 0 | 0 | 0 | 4.27V |
| ⋮ | ⋮ | ⋮ | ⋮ | ⋮ | ⋮ | ⋮ | ⋮ | ⋮ | ⋮ | ⋮ | ⋮ | ⋮ | ⋮ |
| 0 | 1 | 0 | 0 | 1 | 0 | 3.57V | 1 | 1 | 0 | 0 | 1 | 0 | 4.59V |
| 0 | 1 | 0 | 0 | 1 | 1 | 3.60V | 1 | 1 | 0 | 0 | 1 | 1 | 4.62V |
| 0 | 1 | 0 | 1 | 0 | 0 | 3.63V | 1 | 1 | 0 | 1 | 0 | 0 | 4.65V |
| 0 | 1 | 0 | 1 | 0 | 1 | 3.66V | 1 | 1 | 0 | 1 | 0 | 1 | 4.68V |
| 0 | 1 | 0 | 1 | 1 | 0 | 3.70V | 1 | 1 | 0 | 1 | 1 | 0 | 4.71V |
| 0 | 1 | 0 | 1 | 1 | 1 | 3.73V | 1 | 1 | 0 | 1 | 1 | 1 | 4.75V |
| 0 | 1 | 1 | 0 | 0 | 0 | 3.76V | 1 | 1 | 1 | 0 | 0 | 0 | 4.78V |
| 0 | 1 | 1 | 0 | 0 | 1 | 3.79V | 1 | 1 | 1 | 0 | 0 | 1 | 4.81V |
| 0 | 1 | 1 | 0 | 1 | 0 | 3.82V | 1 | 1 | 1 | 0 | 1 | 0 | 4.84V |
| 0 | 1 | 1 | 0 | 1 | 1 | 3.86V | 1 | 1 | 1 | 0 | 1 | 1 | 4.87V |
| 0 | 1 | 1 | 1 | 0 | 0 | 3.89V | 1 | 1 | 1 | 1 | 0 | 0 | 4.91V |
| 0 | 1 | 1 | 1 | 0 | 1 | 3.92V | 1 | 1 | 1 | 1 | 0 | 1 | 4.94V |
| 0 | 1 | 1 | 1 | 1 | 0 | 3.95V | 1 | 1 | 1 | 1 | 1 | 0 | 4.97V |
| 0 | 1 | 1 | 1 | 1 | 1 | 3.98V | 1 | 1 | 1 | 1 | 1 | 1 | 5.00V |

LIQUID CRYSTAL DISPLAY AND COMMON VOLTAGE GENERATING CIRCUIT THEREOF

CROSS-REFERENCE TO RELATED APPLICATION

This U.S. non-provisional patent application claims priority under 35 U.S.C §119 of Korean Patent Application No. 10-2006-88710, filed on Sep. 13, 2006, the entire contents of which are hereby incorporated by reference.

BACKGROUND OF THE INVENTION

The present disclosure relates to a liquid crystal display (LCD) and, more particularly, to a common voltage generating circuit of an LCD.

Recently, as electronic devices have become lightweight and slim, display devices are also required to be lightweight and slim. In order to meet such requirements, a variety of flat panel displays are being rapidly developed and popularized to replace conventional cathode-ray tube (CRT) displays.

A liquid crystal display (LCD) is one of the flat panel displays mentioned above. In the LCD, a common electrode, a color filter, and alignment layer, and so on are formed on an upper substrate, whereas thin-film transistors, pixel electrodes, and alignment layer, and so on are formed on a lower substrate, and a liquid crystal material with dielectric anisotropy is injected between the alignment layer of the upper substrate and the alignment layer of the lower substrate. A predetermined voltage is applied to the pixel electrode and the common electrode to create a predetermined electric field, and the created electric field changes the orientations of the liquid crystal molecules to adjust the light transmittance of the liquid crystal, so that an image may be displayed.

The LCD is thin and light and, thus, is easy to miniaturize. In addition, the LCD has a low driving voltage and a low power consumption and can provide an image quality close to that of the CRT display. Therefore, the LCD is widely used in a variety of devices, such as mobile communications terminals, monitors and notebook computers. In particular, most of the mobile communication terminals, represented by mobile phones, use the LCD as a display device.

In general, the LCD is driven by applying a predetermined range of voltages to data lines, to which the liquid crystal can respond with the respect to a common voltage applied to the common electrode of the upper substrate. If the LCD continues to respond in only one direction, it is degraded in performance. In order to prevent such performance degradation, data voltages that are inverted with respect to the common voltage are applied to the data lines of the LCD.

The common voltage is one of the most important factors that determines the image quality of the LCD. In general, before the shipment of the LCD, the common voltage is adjusted to an optimal value and the optimal common voltage is stored in a register. The system including the LCD is then programmed for optimal display using the optimal common voltage value stored in the register.

The manufacturing environment of an LCD may change due to the movement or expansion of the manufacturing process line after the initial shipment stage. This process instability may change the optimal common voltage that determines the characteristics of the LCD. Typically, it is difficult to store the changed optimal common voltage in the register. The reason for this is that the system program must also be changed when the changed optimal common voltage is stored in the register. This causes a load on the implementation of the system including the LCD. What is therefore required is an approach to setting the common voltage automatically, without changing the system program.

SUMMARY OF THE INVENTION

Exemplary embodiments of the present invention provide a common voltage generating circuit of an LCD, which can set a common voltage automatically and provide an optimal common voltage to a liquid crystal panel, without changing a system program of the system employing the LCD.

Exemplary embodiments of the present invention provide voltage generating circuits including: a first storage unit storing first voltage data; a second storage unit storing second voltage data; and a voltage generator generating a voltage corresponding to one of the first and the second voltage data according to whether the second voltage data is changed.

In exemplary embodiments, the second voltage data is initially stored as a default value.

According to exemplary embodiments, the voltage corresponding to the first voltage data is generated when the second voltage data is the default value.

In exemplary embodiments, the voltage corresponding to the second voltage data is generated when the second voltage data is not the default value.

In exemplary embodiments the default value is '0'.

According to exemplary embodiments, the first storage unit is a register and the second storage unit is a nonvolatile memory.

According to exemplary embodiments, the voltage generator includes: a voltage divider generating a plurality of voltage divisions between a power voltage and a ground voltage; and a selection circuit selecting and outputting one of the voltage divisions, corresponding to one of the first and second voltage data, as the voltage.

In exemplary embodiments of the present invention, liquid crystal displays include: a liquid crystal panel; and a common voltage generating circuit providing a common voltage to the liquid crystal panel, the common voltage generating circuit including: a first storage unit storing first voltage data; a second unit storing second voltage data; and a voltage generator generating the common voltage corresponding to one of the first and second voltage data according to whether the second voltage data is changed.

In exemplary embodiments, the second voltage data is initially stored as a default value.

According to exemplary embodiments, the common voltage corresponding to the first voltage data is generated when the second voltage data is the default value.

In exemplary embodiments, common voltage corresponding to the second voltage data is generated when the second voltage data is not the default value.

In exemplary embodiments, the default value is '0'.

According to exemplary embodiments, the first storage unit is a register and the second storage unit is a nonvolatile memory.

According to exemplary embodiments, the voltage generator includes: a voltage divider generating a plurality of voltage divisions between a power voltage and a ground voltage; and a selection circuit selecting and outputting one of the voltage divisions, corresponding to one of the first and second voltage data, as the common voltage.

In exemplary embodiments, the selection circuit includes: a multiplexer selecting one of the first and second voltage data in response to a selection signal; and a selection signal generator receiving the second voltage data from the second storage unit to generate the selection signal.

In exemplary embodiments, the selection signal generator is an OR gate.

According to exemplary embodiments, the first storage unit is a register and the second storage unit is a nonvolatile memory.

In exemplary embodiments of the present invention, liquid crystal displays include: a liquid crystal panel; and a common voltage generating circuit providing a common voltage to the liquid crystal panel, the common voltage generating circuit including: a first storage unit storing first voltage data; a second storage unit storing a selection signal and second voltage data; and a voltage generator generating the common voltage corresponding to one of the first and second voltage data according to the selection signal.

According to exemplary embodiments, the voltage generator includes: a voltage divider generating a plurality of voltage divisions between a power voltage and a ground voltage; and a selection circuit selecting and outputting one of the voltage divisions, corresponding to one of of the first and second voltage data, as the common voltage in response to the selection signal.

In exemplary embodiments, the selection circuit is a multiplexer.

According to exemplary embodiments, the first storage unit is a register and the second storage unit is a nonvolatile memory.

In exemplary embodiments, the nonvolatile memory is a one-time programmable EEPROM (OTP).

In exemplary embodiments, the nonvolatile memory is a multi-time programmable EEPROM (MTP).

BRIEF DESCRIPTION OF THE FIGURES

Exemplary embodiments of the present invention will be understood in more detail from the following descriptions taken in conjunction with the accompanying figures. In the figures:

FIG. 3 illustrates an example of a table of common voltages that are set depending on data of a nonvolatile memory according to an exemplary embodiment of the present invention;

DETAILED DESCRIPTION OF EXEMPLARY EMBODIMENTS

Exemplary embodiments of the present invention will be described below in more detail with reference to the accompanying figures. The present invention may, however, be embodied in different forms and should not be construed as being limited to the exemplary embodiments set forth herein. Rather, these exemplary embodiments are provided so that this disclosure will be thorough and complete, and will fully convey the scope of the present invention to those of ordinary skill in the art.

Figure 1:
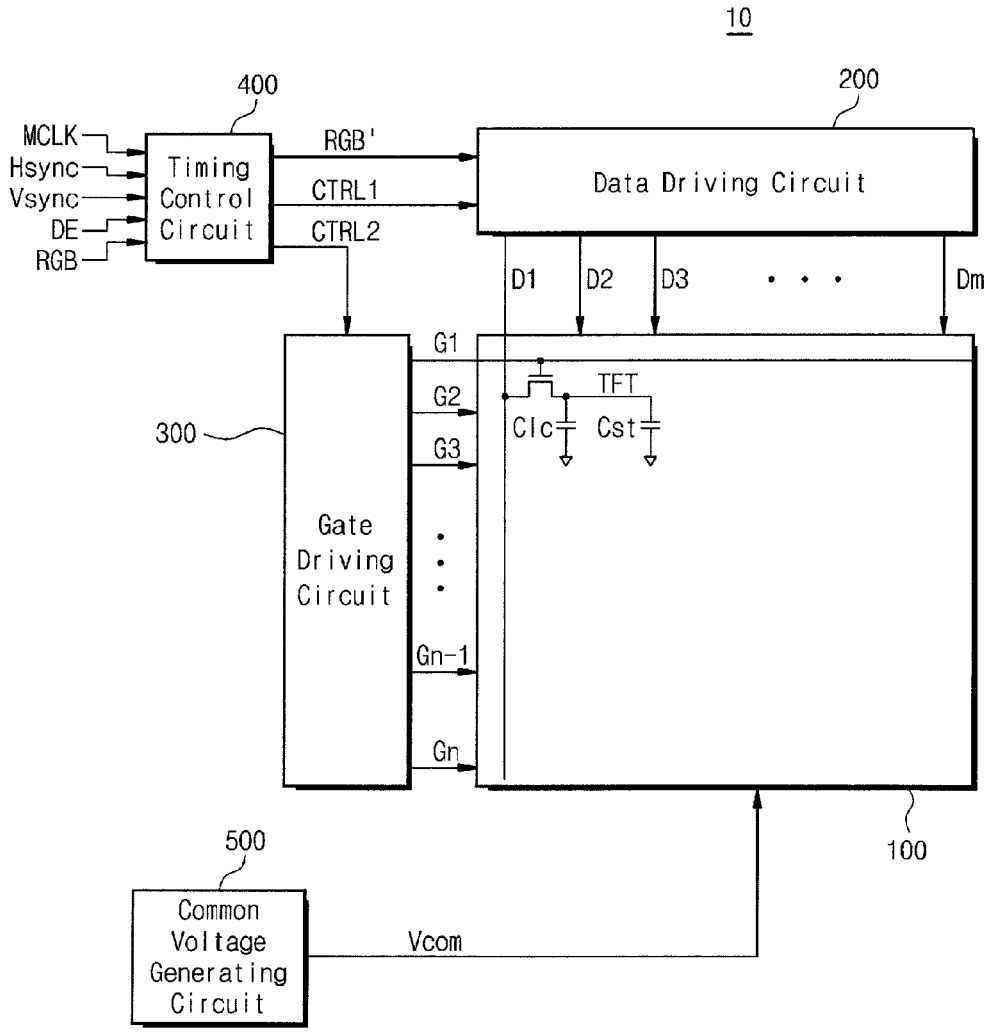
FIG. 1 illustrates an LCD having a common voltage generating circuit according to an exemplary embodiment of the present invention.

FIG. 1 illustrates an LCD having a common voltage generating circuit according to an exemplary embodiment of the present invention.

Referring to FIG. 1, and LCD 10 includes a liquid crystal panel 100, a data driving circuit 200, a gate driving circuit 300, a timing control circuit 400, and a common voltage generating circuit 500.

The liquid crystal panel 100 includes thin-film transistors (TFTs) and liquid crystal cells. The TFTs are formed at intersections between n gate lined G1~Gn and m data lines D1~Dm. The liquid crystal cells are arranged in a matrix configuration and are connected to the TFTs.

In response to a gate signal of the gate lines G1~Gn, the TFT provides data of the data lines D1~Dm to the liquid crystal cell. The liquid crystal cell includes a liquid crystal layer, a common electrode, and a pixel electrode connected to the TFT, wherein the common electrode and the pixel electrode face each other with the liquid crystal layer therebetween, which can be equivalently denoted as a liquid crystal capacitor Clc. The liquid crystal cell further includes a storage capacitor Cst that is connected to the previous gate line to maintain a data voltage charged in the liquid crystal capacitor Clc until the next data voltage is charged.

The timing control circuit 400 receives a data clock MCLK, a horizontal sync signal Hsync, a vertical sync signal Vsync, a data enable signal DE, a red/green/blue (R/G/B) video signal RGB, and the like from an external system (not shown). The timing control circuit 400 outputs an R/G/B digital video signal RGB' and control signals CTRL1 and CTRL2 for controlling the timings of the data driving circuit 200 and the gate driving circuit 300, respectively.

The data driving circuit 200 receives the R/G/B digital video signal RGB' and the control signal CTRL1 from the timing control circuit 400. The data driving circuit 200 latches the R/G/B digital video signal RGB' in response to the control CTRL1, and corrects the latched video signal according to a gamma voltage. The data driving circuit 200 converts the gamma-corrected video signal into an analog video signal, and provides the analog vide signal to the data lines D1~Dm in units of one line.

In response to a gate start pulse received from the timing control circuit 400, the gate driving circuit 300 sequentially drives the gate lines G1~Gn. In response to gate signals G1, G2, . . . , Gn, video data on the data lines D1~Dm are provided to the pixel electrodes of the liquid crystal capacitors Clc.

The common voltage generating circuit 500 generates a common voltage Vcom and provides the generated common voltage Vcom to the common electrode of the liquid crystal capacitor Clc.

In general, the LCD is driven in an inversion mode. Therefore, the video signal provided to the data lines D1~Dm is divided into a positive video signal and a negative video signal. That is, when the gate lines G1~Gn are sequentially drive, a positive or negative video signal is provided to the data lines D1~Dm.

The positive or negative video signals, provided to the data lines D1~Dm as described above, are charged in the liquid crystal cells until the next video signals are provided. At this point, a predetermined image, which corresponds to the positive or negative video signals charged in the liquid crystal cells, is displayed on the liquid panel 100. At this point, an actual image displayed on the liquid crystal panel 100 depends on a difference between the common voltage Vcom and the positive or negative video signal charged in the liquid crystal cell. Therefore, the quality of the image displayed on the liquid crystal panel 100 is determined according to the voltage level of the common voltage Vcom.

The LCD 10 according to an exemplary embodiment of the present invention includes the common voltage generating circuit 500 for generating an optimal common voltage Vcom that is variable. The optimal common voltage Vcom is known by the manufacturer of the liquid crystal panel 100.

Figure 2:
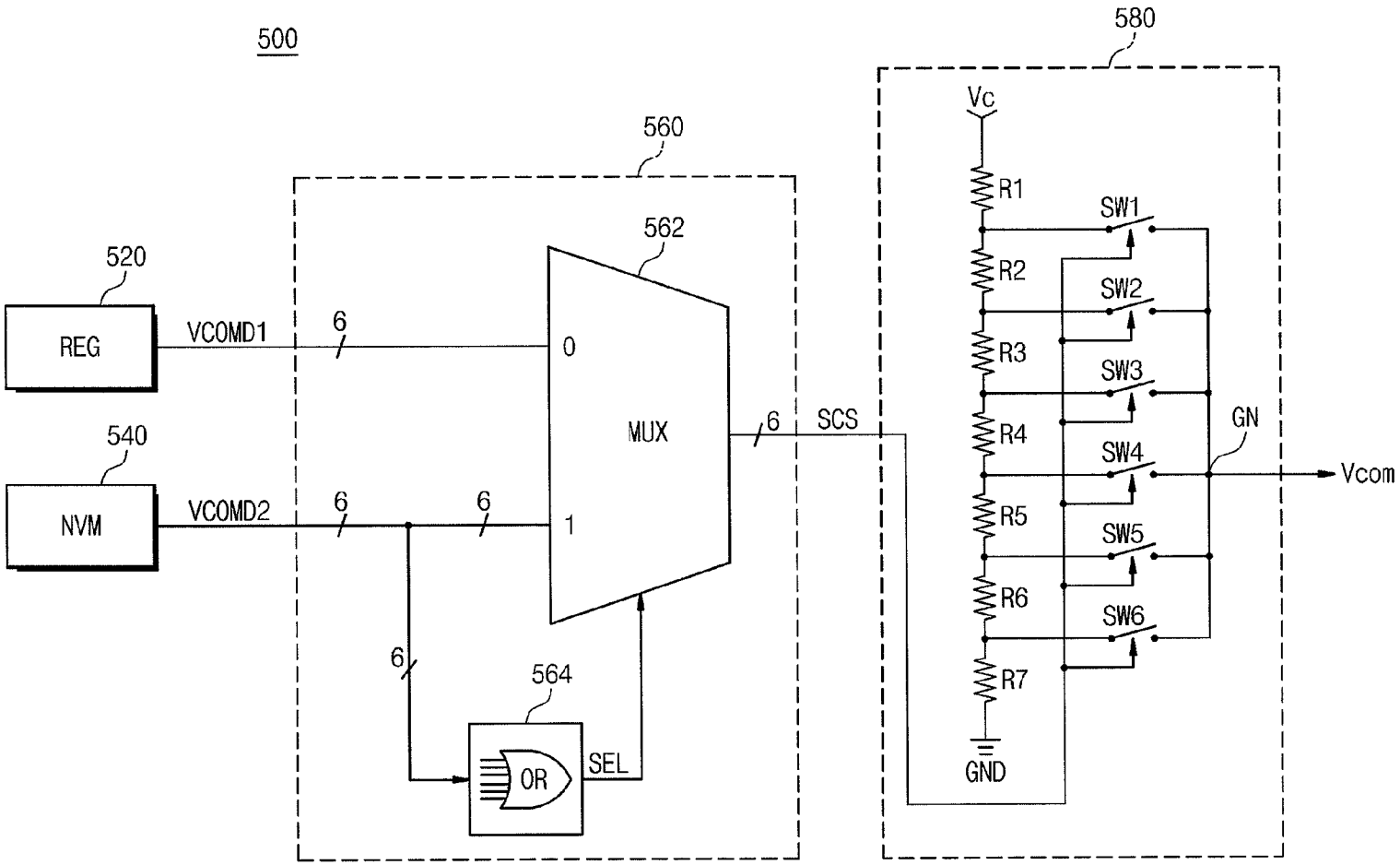
FIG. 2 illustrates an exemplary embodiment of the common voltage generating circuit according to the present invention.

FIG. 2 illustrates an exemplary embodiment of the common voltage generating circuit 500 illustrated in FIG. 1.

Referring to FIG. 2, the common voltage generating circuit 500 includes a register 520, a nonvolatile memory 540, a selection circuit 560, and a voltage dividing circuit 580.

The register 520 stores common voltage data VCOMD1 corresponding to the level of the optimal common voltage Vcom. The nonvolatile memory 540 stores changed common voltage data VCOMD2 for providing the optimal common voltage Vcom when the characteristics of the liquid crystal panel 100 are changed.

The manufacturer of the LCD 10 stores the common voltage data VCOMD1 corresponding to the optimal common voltage in the register 520 at the initial design and manufacture stage. Thereafter, due to the movement or expansion of the manufacturing process line, the characteristics of the liquid crystal panel 100 may change and thus the optimal common voltage may also change. In this exemplary embodiment, the common voltage data VCOMD2 corresponding to the changed common voltage is stored in the nonvolatile memory 540.

A one-time programmable EEPROM (OTP) or a multi-time programmable EEPROM (MTP) may be used as the nonvolatile memory 540. The OTP may be a read only memory (ROM), and the MTP may be a NAND flash memory. In the case of the MTP, stored data can be updated. In the case of the OTP, data can be programmed only one time.

The selection circuit 560 selects one of the common voltage data VCOMD1 stored in the register 520 and the changed common voltage data VCOMD1 stored in the nonvolatile memory 540, and provides the selected common voltage data to the voltage dividing circuit 580. The selection circuit 560 includes a multiplexer 562 and a selection signal generator 564.

The selection signal generator 564 receives the changed common voltage data VCOMD2 stored in the nonvolatile memory 540, and outputs a selection signal SEL corresponding to the changed common voltage data VCOMD2. In response to the selection signal SEL received from the selection signal generator 564, the multiplexer 562 outputs one of the common voltage data VCOMD1 and the changed common voltage data VCOMD2 as a switching control signal SCS.

In response to the switching control signal SCS, the voltage dividing circuit 580 outputs one of a plurality of voltages as the common voltage Vcom. The voltage dividing circuit 580 includes a plurality of switches SW1~SW6 and a plurality of resistors R1~R7 that are connected in series between a power voltage Vc and a ground voltage GND. The switch SW1 is connected between a common voltage output node GN and a connection node between the resistors R1 and R2. Similarly, each of the switches SW2~SW6 is connected between the common voltage output node GN and a connection node between the corresponding two of the resistors R2~R7. The switches SW1~SW6 are controlled respectively by the corresponding hits of the switching control signal SCS received from the selection circuit 560.

Although it has been described that the voltage dividing circuit 580 outputs one of the six divided voltages, generated by the seven resistors R1~R7, as the common voltage Vcom, the number of resistors in the voltage dividing circuit 580 may vary and, accordingly, the number of bits of a signal stored in the nonvolatile memory 540 and the register 520 may also vary.

An operation of the voltage dividing circuit 580 will now be described with reference to FIG. 2.

When the switching control signal SCS is '000100', the switches SW1, SW2, SW3, SW5 and SW6 corresponding to a bit value of '0' are all turned off and only the switch SW4 corresponding to a bit value of '1' is turned on. Therefore, the common voltage Vcom at the common voltage output node GN can be expressed as Equation (1):

$$V_{com} = \frac{R5 + R6 + R7}{R1 + R2 + R3 + R5 + R6 + R7} Vc \quad (1)$$

In this way, by control of the on/off of the switches SW1·SW6, one of the six divided voltages can be outputted as the common voltage Vcom.

The switching control signal SCS for controlling the on/off state of the switches SW1~SW6 is generated as follows:

The register 520 stores the common voltage data VCOMD1 corresponding to the optimal common voltage that was determined at the initial manufacturing stage. The nonvolatile memory 540 stores the changed common voltage data VCOMD2 corresponding to the changed common voltage. When the common voltage corresponding to the common voltage data VCOMD1 is suitable for the liquid crystal panel 100 at the manufacturing test stage of the LCD 10, the manufacturer stores a default value '000000' in the nonvolatile memory 540 as the changed common voltage data VCOMD2. On the other hand, when the common voltage corresponding to the common voltage data VCOMD1 is unsuitable for the liquid crystal panel 100, the manufacturer stores the changed common voltage data VCOMD2 corresponding to the changed optimal common voltage in the nonvolatile memory 540.

If the changed common voltage data VCOMD2 stored in the nonvolatile memory 540 is the default value '000000', the selection signal generator 564 outputs a logic '0' selection signal SEL. Accordingly, the multiplexer 562 outputs the common voltage data VCOMD1 stored in the register 520 as the switching control signal SCS. On the other hand, if the changed common voltage data VCOMD2 stored in the nonvolatile memory 540 is not the default value '000000' and has a non-zero value, the selection signal generator 564 outputs a logic '1' selection signal SEL.

The selection signal generator 564 may be constituted by an OR gate in order to determine whether the changed common voltage data VCOMD2 stored in the nonvolatile memory 540 is the default value '000000' or has a non-zero value. The selection signal generator 564 constituted by the OR gate outputs a logic '0' selection signal SEL when all the bits of the changed common voltage data VCOMD2 are '0', and outputs a logic '1' selection signal SEL when at least one of the bits of the changed common voltage data VCOMD2 is '1'.

FIG. 3 illustrates an exemplary embodiment of a table of the common voltages Vcom that are outputted according to the changed common voltage data VCOMD2 stored in the nonvolatile memory 540 according to the present invention.

Referring to FIG. 3, when the common voltage data VCOMD2 of the nonvolatile memory 540 is the default value '000000', the common voltage generating circuit 500 becomes a setting disable mode. In the setting disable mode, the switching control signal SCS is not outputted according to the common voltage data VCOMD2 of the nonvolatile memory 540. As described above, when the common voltage data VCOMD2 stored in the nonvolatile memory 540 is the default value '000000', the selection signal generator 564 outputs a logic '0' selection signal SEL. Accordingly, in the setting disable mode, the common voltage generating circuit 500 outputs the switching control signal SCS according to the common voltage data VCOMD1 stored in the register 562.

The common voltage data VCOMD1 and VCOMD2 to be stored respectively in the register 520 and the nonvolatile memory 540 of the common voltage generating circuit 500 will now be described with reference to FIGS. 2 and 3, First, it is assumed that the common voltage Vcom for providing the liquid crystal panel 100 with optimal quality is changed as shown in Table 1 below.

TABLE 1

| | |
|---|---|
| The optimal common voltage at the initial manufacturing stage | 3.16 V |
| The changed optimal common voltage | 3.25 V |

Referring to Table 1, the optimal common voltage Vcom of the LCD at the initial manufacturing stage is 3.16 V. Referring to FIGS. 2 and 3, the common voltage data VCOMD1 '000101' corresponding to a voltage of 3.16 V is stored in the register 520, and the default value '000000' is then stored in the nonvolatile memory 540. Accordingly, the selection signal generator 564 outputs a logic '0' selection signal SEL corresponding to the common voltage data VCOMD2 '000000' stored in the nonvolatile memory 540. In response to the logic '0' selection signal SEL, the multiplexer 562 selects the common voltage data VCOMD1 '000101' stored in the register 520 as the switching control signal SCS. In response to the '000101' switching control signal SCS, the voltage dividing circuit 580 outputs a voltage of 3.16 V as the common voltage Vcom. Accordingly, the LCD 10 generates a voltage of 3.16 V as the common voltage Vcom. In a system including the LCD 10 generating the unchanged common voltage Vcom, a system program is written using the common voltage data VCOMD1 '000101' stored in the register 520.

On the other hand, the optimal common voltage Vcom has been changed to 3.25 V due to some movement or expansion of the manufacturing process line. Referring to FIG. 3, the changed common voltage data VCOMD2 '001000' corresponding to a voltage of 3.25 V is stored in the nonvolatile memory 540. At this point, the common voltage data VCOMD1 '000101' corresponding to a voltage of 3.16 V is still stored in the register 520. Then, the selection signal generator 564 outputs a logic '1' selection signal SEL according to the changed common voltage data VCOMD2 '001000' stored in the nonvolatile memory 540. In response to the logic '1' selection signal SEL, the multiplexer 562 selects the changed common voltage data VCOMD2 stored in the nonvolatile memory 540 as the switching control signal SCS. In response to the '001000' switching control signal SCS, the voltage dividing circuit 580 outputs a voltage of 3.25 V as the common voltage Vcom. Accordingly, the LCD 10 generates a voltage of 3.25 V as the common voltage Vcom. In a system including the LCD 10 generating the changed common voltage Vcom, a system program is written using the common voltage data VCOMD1 '000101' stored in the register 520.

Therefore, the system program of the system including the LCD 10 of the present invention need not be changed even when the common voltage is changed. The reason for this is that the system program is written using the common voltage data VCOMD1 '000101' stored in the register 520 and the system program need not contain steps to accommodate the changed common voltage.

The optimal common voltage Vcom of the LCD 10 may vary with each manufacturing process line. For example, the optimal common voltage Vcom for a first process line may be 3.16 V, while the optimal common voltage Vcom for a second process line may be 3.25 V. In this case, during the shipment stage following manufacturing of the LCD 10, the manufacturer selects one of 3.16 V and 3.25 V as the common voltage Vcom and stores the corresponding common voltage data VCOMD1 in the register 520. If the optimal common voltage Vcom for the first process line, that is, 3.16 V, is selected as the common voltage Vcom, the common voltage data VCOMD1 and VCOMD2 stored in the register 520 and the nonvolatile memory 540 for the respective process lines are as shown in Table 2 below.

TABLE 2

| | Line 1 | Line 2 |
|---|---|---|
| The common voltage data VCOMD1 in the register | 000101 | 000101 |
| The common voltage data VCOMD2 in the nonvolatile memory | 000000 | 001000 |

Referring to Table 2, in the case of the LCD manufactured by the first process line, the common voltage data VCOMD1 stored in the register 520 is '000101' and the common voltage data VCOMD2 stored in the nonvolatile memory 540 is '000000'. Likewise, in the case of the LCD manufactured by the second process line, the common voltage data VCOMD1 stored in the register 520 is '000101' and the common voltage data VCOMD2 stored in the nonvolatile memory 540 is '001000'.

Both of the LCDs manufactured by the first and second process lines store the same common voltage data VCOMD1, that is, '000101', in the register 520. Accordingly, a system including the LCD manufactured by the first process line and another system including the LCD manufactured by the second process line can have the same system program.

According to exemplary embodiments of the present invention, the common voltage generating circuit 500 provides the optimal common voltage Vcom to the liquid crystal panel 100 according to the changed common voltage data VCOMD2 stored in the nonvolatile memory 540. In addition, according to the common voltage generating circuit 500, the system program of the system including the LCD 10 need not be changed even when the optimal common voltage Vcom is changed.

Figure 4:
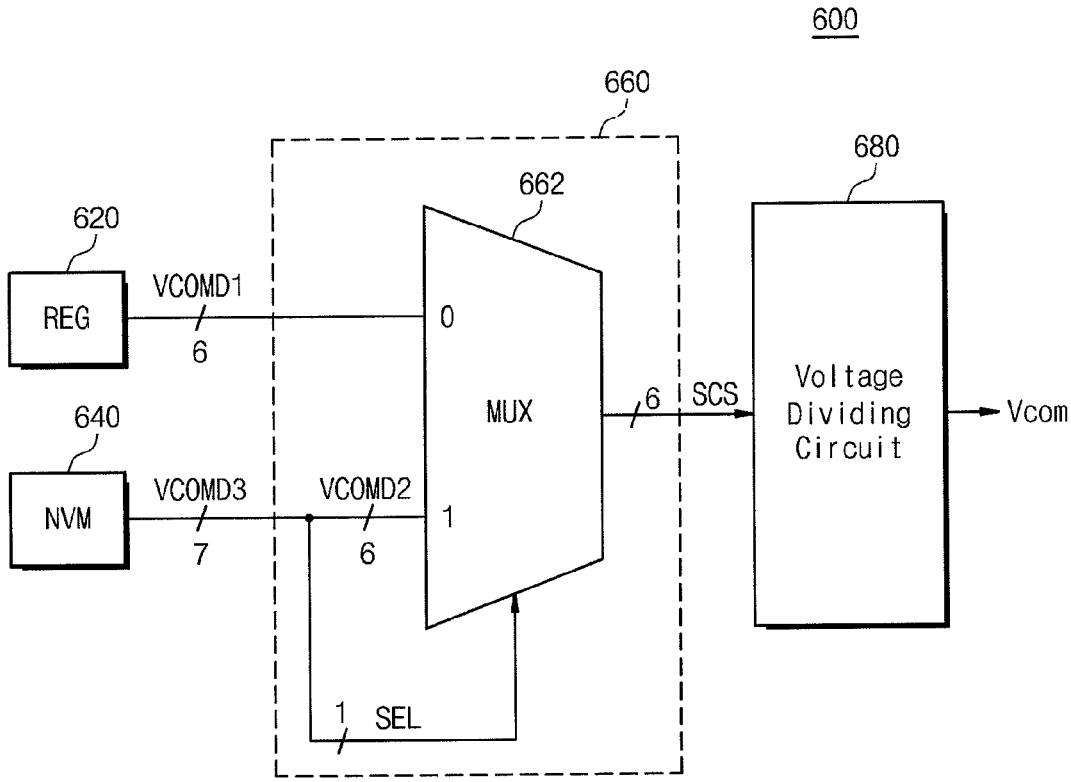
FIG. 4 illustrates and exemplary embodiment of the common voltage generating circuit according to the present invention.

FIG. 4 illustrates an exemplary embodiment of the common voltage generating circuit according to the present invention.

Referring to FIG. 4, a common voltage generating circuit 600 includes a register 620, a nonvolatile memory 640, a selection circuit 660, and a voltage dividing circuit 680.

Like the register 520 in FIG. 2, the register 620 stores common voltage data VCOMD1 corresponding to the level of an optimal common voltage Vcom.

The nonvolatile memory 640 stores data VCOMD3. The data VCOMD3 includes a selection signal SEL and common voltage data VCOMD2. The common voltage data VCOMD2 is to provide the optimal common voltage Vcom to the liquid crystal panel 100 when the characteristics of the liquid crystal panel 100 are changed. The selection signal SEL enables the selection circuit 660 to select one of the common voltage data VCOMD1 stored in the register 620 or the common voltage data VCOMD2 stored in the nonvolatile memory 640 as a switching control signal SCS for the voltage dividing circuit 680.

Figure 5:
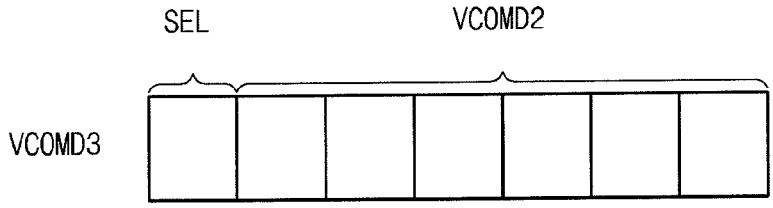
FIG. 5 illustrates the structure of data stored in the nonvolatile memory.

FIG. 5 illustrates the structure of the data VCOMD3 stored in the nonvolatile memory 640 shown in FIG. 4.

Referring to FIG. 5, the data VCOMD3 stored in the nonvolatile memory 640 includes 6-bit common voltage data VCOMD2 and a 1-bit selection signal SEL.

In response to the selection signal SEL, a multiplexer 662 of the selection circuit 660 selects one of the common voltage data VCOMD1 stored in the register 620 and the common voltage data VCOMD2 stored in the nonvolatile memory 640 as the switching control signal SCS. Referring to FIG. 4, when the selection signal SEL is '0', the multiplexer 662 selects the common voltage data VCOMD1 stored in the register 620 as the switching control signal SCS On the other hand, when the selection signal SEL is '1', the multiplexer 662 selects the common voltage data VCOMD2 stored in the nonvolatile memory 640 as the switching control signal SCS.

Like the voltage dividing circuit 580 illustrated in FIG. 2, the voltage dividing circuit 680 outputs one of a plurality of divided voltages as the common voltage Vcom in response to the switching control signal SCS.

As described above, the common voltage generating circuit of exemplary embodiments of the present invention provides the optimal common voltage to the LCD according to the data stored in the nonvolatile memory. Accordingly, the system program of the system employing the LCD need not be changed, even when the optimal common voltage provided to the liquid crystal panel is changed.

The above-disclosed subject matter is to be considered illustrative, and not restrictive, and the appended claims are intended to cover all such modifications, enhancements, and exemplary embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A voltage generating circuit comprising:
a first storage unit storing first voltage data;
a second storage unit storing second voltage data;
a selection circuit receiving the first and second voltage data and selecting one of the first or second voltage data according to whether the second voltage data is equal to a default value for an optimal common voltage; and
a voltage divider outputting the optimal common voltage corresponding to the selected voltage data among a plurality of divided voltages having respective predetermined values between a power voltage and a ground voltage.

2. The voltage generating circuit of claim 1, wherein the second voltage data is initially stored as the default value.

3. The voltage generating circuit of claim 2, wherein the optimal common voltage corresponding to the first voltage data is generated by the voltage generator when the second voltage data is the default value.

4. The voltage generating circuit of claim 3, wherein the optimal common voltage corresponding to the second voltage data is generated by the voltage generator when the second voltage data is not the default value.

5. The voltage generating circuit of claim 2, wherein the default value is '0'.

6. The voltage generating circuit of claim 1, wherein the first storage unit is a register and the second storage unit is a nonvolatile memory.

7. A liquid crystal display comprising:
a liquid crystal panel; and
a common voltage generating circuit providing a common voltage to the liquid crystal panel, the common voltage generating circuit comprising:
a first storage unit storing first voltage data;
a second storage unit storing second voltage data; and
a selection circuit receiving the first and second voltage data and selecting one of the first or second voltage data according to whether the second voltage data is equal to a default value for generating an optimal common voltage; and
a voltage divider outputting the optimal common voltage corresponding to the selected voltage data among a plurality of divided voltages having respective predetermined values between a power voltage and a ground voltage.

8. The liquid crystal display of claim 7, wherein the second voltage data is initially stored as the default value.

9. The liquid crystal display of claim 8, wherein the optimal common voltage corresponding to the first voltage data is generated by the voltage generator when the second voltage data is the default value.

10. The liquid crystal display of claim 9, wherein the optimal common voltage corresponding to the second voltage data is generated by the voltage generator when the second voltage data is not the default value.

11. The liquid crystal display of claim 8, wherein the default value is '0'.

12. The liquid crystal display of claim 7, wherein the first storage unit is a register and the second storage unit is a nonvolatile memory.

13. The liquid crystal display of claim 7, wherein the selection circuit comprises:
a multiplexer selecting one of the first and second voltage data in response to a selection signal; and
a selection signal generator receiving the second voltage data from the second storage unit and generating the selection signal.

14. The liquid crystal display of claim 13, wherein the selection signal generator is an OR gate.

15. The liquid crystal display of claim 14, wherein the first storage unit is a register and the second storage unit is a nonvolatile memory.

16. A liquid crystal display comprising:
a liquid crystal panel; and
a common voltage generating circuit providing a common voltage to the liquid crystal panel, the common voltage generating circuit comprising:
a first storage unit storing first voltage data;
a second storage unit storing a selection signal and second voltage data;
a selection circuit receiving the first and second voltage data and selecting one of the first or second voltage data according to the selection signal for generating an optimal common voltage; and
a voltage divider outputting the optimal common voltage corresponding to the selected voltage data among a plurality of divided voltages having respective predetermined values between a power voltage and a ground voltage.

17. The liquid crystal display of claim 16, wherein the selection circuit comprises a multiplexer.

18. The liquid crystal display of claim 17, wherein the first storage unit is a register and the second storage unit is a nonvolatile memory.

19. The liquid crystal display of claim 12, wherein the nonvolatile memory is a one-time programmable EEPROM.

20. The liquid crystal display of claim 12, wherein the nonvolatile memory is a multi-time programmable EEPROM.

21. The liquid crystal display of claim 15, wherein the nonvolatile memory is a one-time programmable EEPROM.

22. The liquid crystal display of claim 18, wherein the nonvolatile memory is a one-time programmable EEPROM.

23. The liquid crystal display of claim 15, wherein the nonvolatile memory is a multi-time programmable EEPROM.

24. The liquid crystal display of claim 18, wherein the nonvolatile memory is a multi-time programmable EEPROM.

* * * * *